US006661170B2

(12) United States Patent
Amemiya

(10) Patent No.: US 6,661,170 B2
(45) Date of Patent: Dec. 9, 2003

(54) PLASMA DISPLAY PANEL

(75) Inventor: Kimio Amemiya, Yamanashi-ken (JP)

(73) Assignees: Pioneer Corporation, Tokyo (JP); Shizuoka Pioneer Corporation, Shizuoka-ken (JP)

( * ) Notice: Subject to any disclaimer, the term of this patent is extended or adjusted under 35 U.S.C. 154(b) by 0 days.

(21) Appl. No.: 10/212,728

(22) Filed: Aug. 7, 2002

(65) Prior Publication Data

US 2003/0052604 A1 Mar. 20, 2003

(30) Foreign Application Priority Data

Sep. 18, 2001 (JP) ..... 2001-283224

(51) Int. Cl.[7] ..... H01J 17/49
(52) U.S. Cl. ..... 313/582; 313/292
(58) Field of Search ..... 313/582, 583, 313/584, 585, 586, 587, 292

(56) References Cited

U.S. PATENT DOCUMENTS 5,747,939 A * 5/1998 Kim et al. ..... 315/169.4
6,512,330 B2 * 1/2003 Nakajima et al. ..... 313/586

* cited by examiner

*Primary Examiner*—Edward J. Glick
*Assistant Examiner*—Elizabeth Gemmell
(74) *Attorney, Agent, or Firm*—Arent Fox Kintner Plotkin & Kahn

(57) ABSTRACT

Each of partition walls 25 comprises vertical walls 25*a* each positioned between adjacent discharge cells C1 in the row direction and extending in the column direction to form a partition between the adjacent discharge cells C1, and transverse walls 25*b* bridging the vertical walls 25*a* to define a top and bottom edge of the discharge cells C1. Each of the transverse walls 25*b* of the partition wall 25 is provided in a shape that its central part j1 located midway between adjacent vertical walls 25*a* protrudes beyond its part j2 coupled to the vertical wall 25*a* toward the outside of the discharge cell C1 in the column direction.

7 Claims, 8 Drawing Sheets

V3—V3 SECTION

V4—V4 SECTION

W3 — W3 SECTION

V 1 — V 1 SECTION

V 2 — V 2 SECTION

W 1 —W 1 SECTION

W 2 —W 2 SECTION

PLASMA DISPLAY PANEL

BACKGROUND OF THE INVENTION

1. Field of the Invention

The invention relates to a surface-discharge-scheme alternating-current-type plasma display panel, and more particularly, to configuration of a partition wall for partitioning a discharge space of the plasma display panel.

The present application claims priority from Japanese Application No. 2001-283224, the disclosures of which are incorporated herein by reference for all purposes.

2. Description of the Related Art

In recent times, a surface-discharge-scheme alternating-current-type plasma display panel becomes increasingly commonplace as a slim, large sized color screen display.

FIG. 7 to FIG. 11 illustrate a panel structure of a conventional surface-discharge-scheme alternating-current-type plasma display panel (hereinafter referred to as "PDP"). FIG. 7 is a schematic front view of the conventional PDP. FIG. 8 is a sectional view taken along the V1—V1 line of FIG. 7. FIG. 9 is a sectional view taken along the V2—V2 line of FIG. 7. FIG. 10 is a sectional view taken along the W1—W1 line of FIG. 7. FIG. 11 is a sectional view taken along the W2—W2 line of FIG. 7.

In FIGS. 7 to 11, a front glass substrate 10 serving as the display surface of the PDP has a back surface on which a plurality of row electrode pairs (X, Y) are arranged in parallel to each other in a column direction of the front glass substrate 10 (in the vertical direction in FIG. 7).

Each of the row electrodes X is constructed of transparent electrodes Xa each of which is formed of a T-shaped transparent conductive film made of ITO or the like, and a bus electrode Xb which is formed of a metal film having a double-layer structure made up of a black conductive layer and a main conductive layer. The bus electrode Xb extends in the row direction of the front glass substrate 10 and is connected to a base member, having a smaller width, of each of the transparent electrodes Xa.

Likewise, each of the row electrodes Y is constructed of transparent electrodes Ya each of which is formed of a T-shaped transparent conductive film made of ITO or the like, and a bus electrode Yb which is formed of a metal film having a double-layer structure made up of a black conductive layer and a main conductive layer. The bus electrode Yb extends in the row direction of the front glass substrate 10 and is connected to a base member, having a smaller width, of each of the transparent electrodes Ya.

The row electrodes X and Y are arranged in alternate positions in the column direction of the front glass substrate 10 (the vertical direction in FIG. 7). In each row electrode pair, each of the transparent electrodes Xa placed along the bus electrodes Xb extends toward the bus electrode Yb and each of the transparent electrodes Ya placed along the bus electrode Yb extends toward the bus electrode Xb, so that the tops of larger-width members of the respective transparent electrodes Xa and Ya are opposite to each other with a discharge gap g, having a predetermined width, in between.

A dielectric layer 11 is also formed on the back surface of the front glass substrate 10 so as to cover the row electrode pairs (X, Y). On the back surface of the dielectric layer 11, an additional dielectric layer 11A protrudes from the back surface of the dielectric layer 11 in a position opposite to the adjacent bus electrodes Xb and Yb of the respective row electrode pairs (X, Y) adjacent to each other and also opposite to a region between the adjacent bus electrodes Xb and Yb concerned. The additional dielectric layer 11A is formed so as to extend in parallel to the bus electrodes Xb, Yb.

A protective layer 12 made of MgO is formed on the back surfaces of the dielectric layer 11 and additional dielectric layers 11A.

The front glass substrate 10 is situated in parallel to a back glass substrate 13 having a surface facing toward the display surface on which column electrodes D are arranged parallel to each other at predetermined intervals and each extends in a direction at right angles to the row electrode pair (X, Y) (the column direction) in a position opposite to the paired transparent electrodes Xa and Ya in each of the row electrode pairs (X, Y).

On the surface of the back glass substrate 13 on the display surface side, a white dielectric layer 14 covers the column electrodes D, and partition walls 15 are formed on the dielectric layer 14.

Each of the partition walls 15 is shaped in a ladder pattern with vertical walls 15*a* each of which extends in the column direction in a position between two adjacent column electrodes D arranged in parallel, and transverse walls 15*b* each of which extends in the row direction in a position opposite to the additional dielectric layer 11A.

The ladder-shaped partition walls 15 are arranged in parallel to each other in the column direction such that an interstice SL is interposed between adjacent partition walls 15 in a position opposite to an area between the bus electrodes Xb and Yb of the row electrodes X and Y which are adjacent to each other in the column direction and positioned back to back.

Each of the ladder-shaped partition walls 15 partitions the discharge space, interposed between the front glass substrate 10 and the back glass substrate 13, into areas each opposite to the transparent electrodes Xa and Ya paired in each row electrode pair (X, Y), to define discharge cells C each formed in a quadrangular shape.

In each discharge cell C, a phosphor layer 16 is provided on a face of the dielectric layer 14 and the four side faces of the vertical walls 15*a* and transverse walls 15*b* of the partition wall 15 which face toward the discharge cell C so as to cover all the five faces. The phosphor layers 16 are arranged in order a red color (R), a green color (G) and a blue color (B) in the row direction for each discharge cell C.

The discharge space is filled with a discharge gas.

In FIGS. 7 to 11, reference numeral 17 represents a black light absorption layer (light shield layer) formed between the back-to-back bus electrodes Xb and Yb of the respective row electrodes X and Y adjacent to each other in the column direction, and reference numeral 18 represents a light absorption layer (light shield layer) formed in a position opposite to each vertical wall 15*a* of the partition wall 15.

The PDP displays images as follows: first, an addressing discharge is selectively caused between one of the row electrodes X, Y and the column electrode D in each discharge cells C. As a result, lighted cells and non-lighted cells are distributed over the panel surface in accordance with an image to be displayed.

Then, a discharge sustaining pulse is applied alternately to the row electrodes X and Y of each pair for a sustaining discharge. Ultraviolet rays generated through the sustaining discharge in each lighted cell excites the red (R), green (G) or blue (B) phosphor layer 16 in each lighted cell to allow the phosphor layer 16 to emit light.

In the panel structure of the conventional PDP as described above, a connection part between the bus electrode Xb, Yb and each of the base members of the transparent electrodes Xa, Ya of each of the row electrodes X and Y is situated in a position overlapping the connection part and the transverse wall 15*b* of the partition wall 15 when viewed from the display surface of the front glass substrate 10. For the reason of this positional relationship, the sustaining discharge produced between the transparent electrodes Xa and Ya in each of the row electrode pairs (X, Y) is impaired by the transverse wall 15*b* of the partition wall 15, to induce deterioration of its discharge properties, leading to a problem of adversely affecting the forming of images.

With increasingly higher definition of the PDP in recent times, the width between the transverse walls 15*b* of each partition wall 15 (width of the discharge cell C in the column direction) is increasingly smaller. For this reason, providing a sufficient width of the discharge cell C in the column direction makes it difficult to prevent the deterioration of the sustaining discharge properties.

SUMMARY OF THE INVENTION

The present invention has been made to solve the problems associated with conventional surface-discharge-scheme alternating-current-type plasma display panels as described above.

It is therefore an object of the present invention to provide a plasma display panel which is capable of preventing the properties of a sustaining discharge from being adversely affected by a partition wall provided for defining discharge cells in order to form an image with high definition.

To attain the above object, according to a first feature of the present invention, a plasma display panel including: a front substrate; a plurality of row electrode pairs arranged in a column direction on a back surface of the front substrate, and each extending in a row direction and forming a display line; a back substrate placed opposite the front substrate with a discharge space interposed; and a plurality of column electrodes arranged in the row direction on a surface of the back substrate facing toward the front substrate, and each extending in the column direction to intersect the row electrode pairs and form unit light-emitting areas in the discharge space at the respective intersections. The plasma display panel in the first feature comprises partition walls provided between the front substrate and the back substrate for defining each of the unit light-emitting areas, each of the partition walls comprising: vertical walls each positioned between adjacent unit light-emitting areas of the unit light-emitting areas in the row direction and extending in the column direction to form a partition between the adjacent unit light-emitting areas; and transverse walls bridging the vertical walls to define a top and bottom edge of the unit light-emitting areas, each transverse wall having an edge part, defining each of the unit light-emitting areas, having a central part located midway between adjacent vertical walls of the vertical walls protruding beyond a part coupled to the vertical wall toward the outside of the unit light-emitting area in the column direction.

With the plasma display panel according to the first feature, the partition walls having the vertical walls extending in the column direction and the transverse walls extending in the row direction partition the discharge space interposed between the front substrate and the back substrate into the unit light-emitting areas.

In between vertical walls of the partition wall arranged in the row direction, the transverse wall has the edge part defining the top or bottom edge of the unit light-emitting area. The edge part has the central part located midway between the vertical walls adjacent to each other, and the coupling part at which the transverse wall is coupled to the vertical wall. The central part protrudes beyond the coupling part toward the outside of the unit light-emitting area in the column direction. Accordingly, each of the unit light-emitting areas defined by the partition wall has a length in the column direction between the central parts of the transverse walls between the adjacent vertical walls longer than that between the coupling parts at which the transverse walls are coupled to the vertical wall.

As a result, the first feature allows the offset arrangement of the row electrode and the transverse wall of the partition wall, both of which extend in the row direction and are arranged approximately in the same position when viewed from the front substrate, in the mid-position between adjacent vertical walls to prevent the row electrode and the transverse wall from complete overlapping each other, when viewed from the front substrate.

For example, when each of the row electrodes comprises a bus electrode extending in the row direction and transparent electrodes each protruding in island-like form from the bus electrode in the column direction in each unit light-emitting area, it is possible to place the connecting part between the bus electrode and transparent electrode of the row electrode in a position in which the connecting part does not overlap the transverse wall of the partition wall when viewed from the front substrate.

Thus, the plasma display panel provided by the present invention is capable of preventing the sustaining discharge, caused between the row electrodes when an image is generated, from being impaired by the transverse wall of the partition wall to induce deterioration of its discharge properties to thereby adversely affect the forming of images, and further is capable of forming the images with high definition because the adequate discharge properties are provided.

To attain the aforementioned object, a plasma display panel has, in addition to the configuration of the first feature, a second feature in that the transverse wall is formed in a band shape protruding toward the outside of each of the unit light-emitting areas in the column direction and toward a central point midway between the adjacent vertical walls from a point coupled to one of the adjacent vertical walls.

With the plasma display panel according to the second feature, each of the partition walls is shaped in an approximate ladder shape with the vertical walls arranged at required intervals in the row direction and a pair of band-shaped transverse walls coupling the vertical walls, arranged in the row direction, at both ends of each of the vertical walls. Each of the pair of band-shaped transverse walls has a shape protruding the central part, located midway between adjacent vertical walls, beyond the part coupled to the vertical wall toward the outside of the unit light-emitting area in the column direction.

Due to this shape, the partition wall defines the unit light-emitting areas such that each of the unit light-emitting areas has a length in the column direction between the central parts of the transverse walls located midway between the adjacent vertical walls longer than that between the parts at which the transverse walls are coupled to the vertical wall.

To attain the aforementioned object, a plasma display panel has, in addition to the configuration of the second feature, a third feature in that the transverse wall extends linearly toward the central point midway between the adjacent vertical walls from the point coupled to the one of the adjacent vertical walls.

With the plasma display panel according to the third feature, the transverse wall of the approximately ladder-shaped partition wall has a V-letter or inverted-V-letter shape between adjacent vertical walls. Due to this shape, the partition wall defines the unit light-emitting areas such that each of the unit light-emitting areas has a length in the column direction between the central parts of the transverse walls midway between the adjacent vertical walls longer than that between the parts at which the transverse walls are coupled to the vertical wall.

To attain the aforementioned object, a plasma display panel has, in addition to the configuration of the second feature, a fourth feature in that the transverse wall extends in a curved line toward the central point midway between the adjacent vertical walls from the point coupled to the one of the adjacent vertical walls.

With the plasma display panel according to the fourth feature, the transverse wall of the approximately ladder-shaped partition wall is curved between adjacent vertical walls to protrude toward the outside of each unit light-emitting area in the column direction and toward the central part located midway between the adjacent vertical walls from the part coupled to the vertical wall. Due to this curved shape, the partition wall defines the unit light-emitting areas such that each of the unit light-emitting areas has a length in the column direction between the central parts of the transverse walls located midway between the adjacent vertical walls longer than that between the parts at which the transverse walls are coupled to the vertical wall.

To attain the aforementioned object, a plasma display panel has, in addition to the configuration of the fourth feature, a fifth feature in that the transverse wall is formed in an arc shape curving in a direction of the outside of the unit light-emitting area in the column direction, between the adjacent vertical walls.

With the plasma display panel according to the fifth feature, the transverse wall of the approximately ladder-shaped partition wall is formed in a shape of continuing the arc shapes each bridged between adjacent vertical walls such that a central part of each of the arcs protrudes toward the outside of each unit light-emitting area in the column direction. Due to this shape, the partition wall defines the unit light-emitting areas such that each of the unit light-emitting areas has a length in the column direction between the central parts of the transverse walls located midway between the adjacent vertical walls longer than that between the parts at which the transverse walls are coupled to the vertical wall.

To attain the aforementioned object, a plasma display panel has, in addition to the configuration of the first feature, a sixth feature in that each of the vertical walls of the partition wall in one row, arranged at required intervals in the row direction, is placed in a position shifted by a required length from a corresponding vertical wall of the vertical walls in another row adjacent to the one row in the column direction.

With the plasma display panel according to the sixth feature, the vertical walls of the partition wall in one row (or line) are offset in positions in the row direction with respect to the corresponding vertical walls in another row adjacent to the one row in the column direction so that the vertical walls of the partition walls are arranged in an approximately corrugated form in the column direction. Hence, when the central part of the transverse wall located midway between the adjacent vertical walls of the partition wall protrudes in a direction of another partition wall adjacent to the above partition wall in the column direction, the interference of the protruding parts of the opposite transverse wall of the adjacent partition walls is avoided.

Thus, the spacing between adjacent partition walls in the column direction is successfully decreased, resulting in improvement in high definition of the plasma display panel.

To attain the aforementioned object, a plasma display panel has, in addition to the configuration of the sixth feature, a seventh feature in that the adjacent vertical walls in two rows adjacent to each other in the column direction are shifted in the row direction by a length corresponding to half a length between the vertical walls adjacent to each other in the row direction in each row.

With the plasma display panel according to the seventh feature, the vertical wall of the partition wall in one row is placed in a position shifted in the row direction with respect to the corresponding vertical wall in another row adjacent to the one row in the column direction by a length corresponding to half the spacing between the vertical walls adjacent to each other in the row direction in each row, or equivalently, in a position shifted in the row direction by a one-half pitch of the unit light-emitting area, defined by the partition wall, in the row direction, so that the vertical walls are positioned zigzag in the column direction.

Thus, the spacing between adjacent partition walls in the column direction is successfully decreased as much as possible, resulting in improvement in high definition of the plasma display panel.

These and other objects and features of the present invention will become more apparent from the following detailed description with reference to the accompanying drawings.

DETAILED DESCRIPTION OF THE PREFERRED EMBODIMENT

Preferred embodiments according to the present invention will be described hereinafter in detail with reference to the accompanying drawings.

Figure 1:
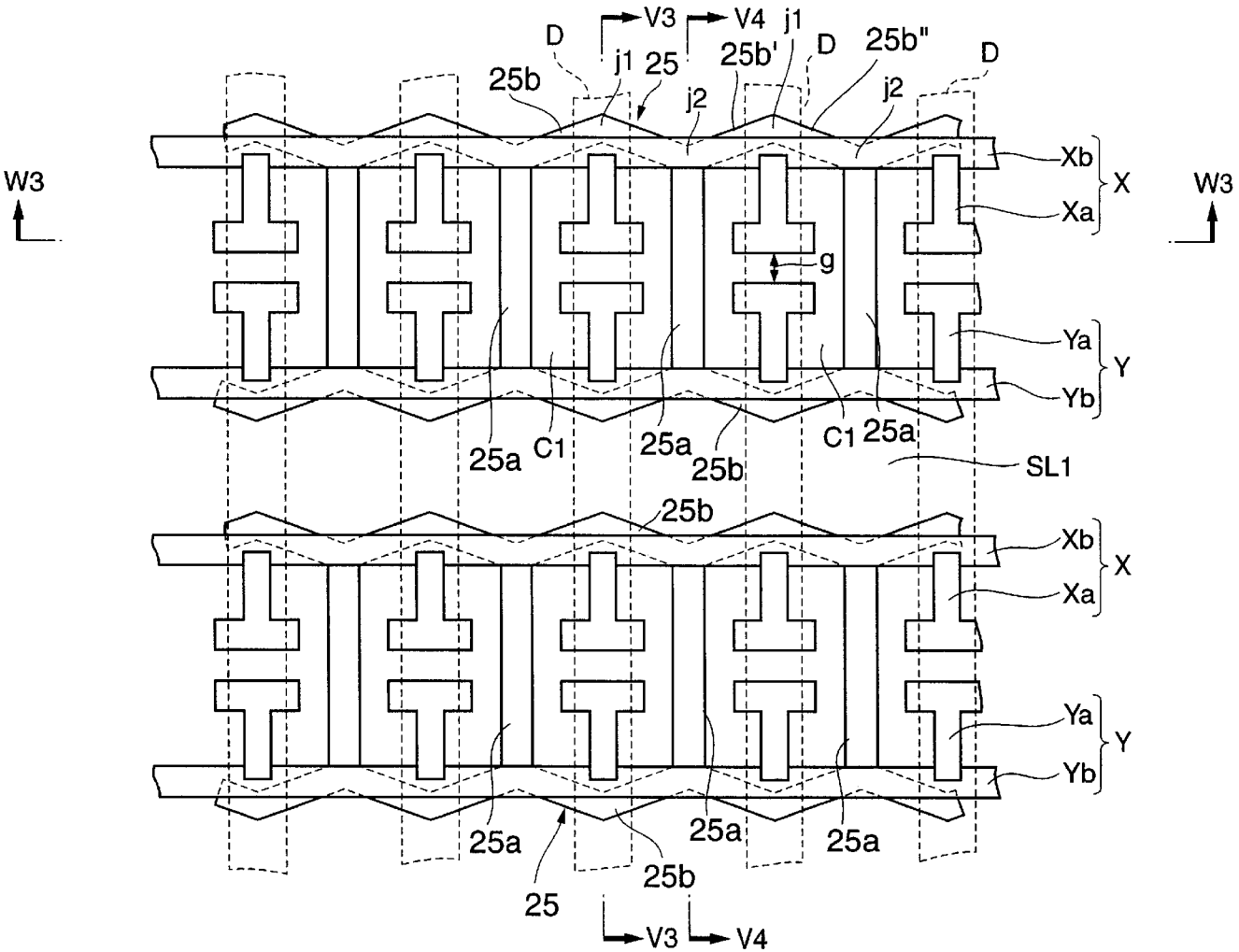
FIG. 1 is a schematic front view illustrating a first embodiment according to the present invention.
Figure 2:
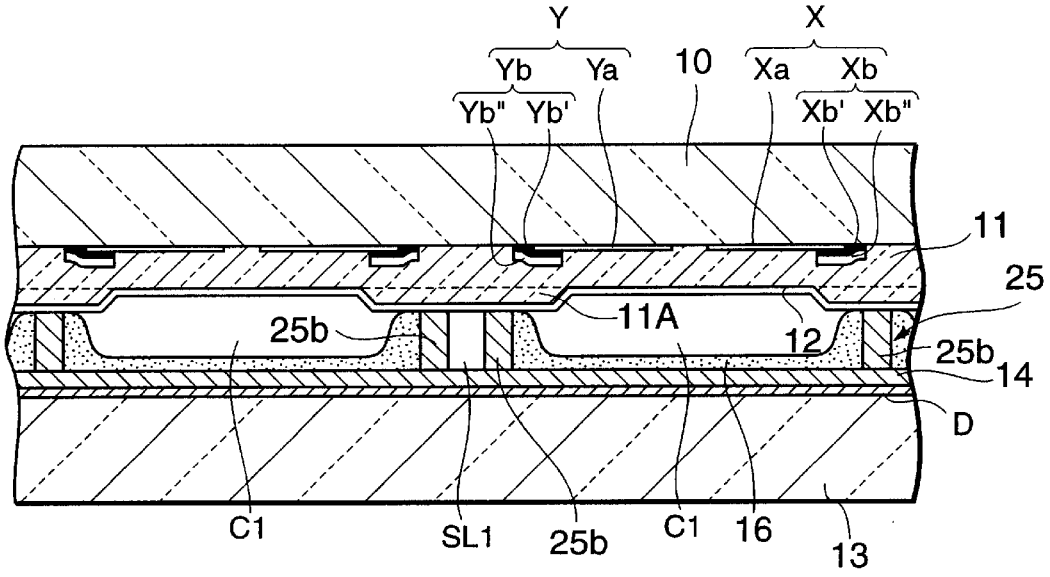
FIG. 2 is a sectional view taken along the V3—V3 line of FIG. 1.
Figure 3:
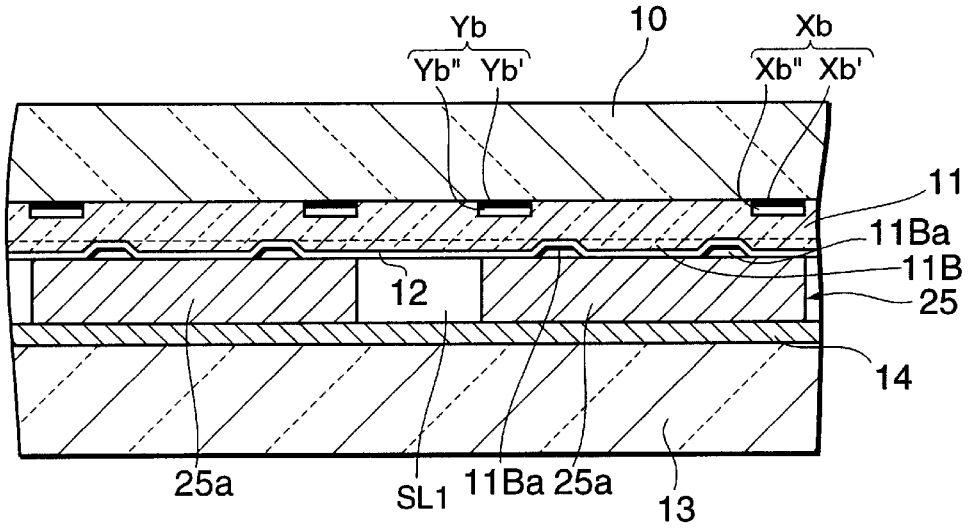
FIG. 3 is a sectional view taken along the V4—V4 line of FIG. 1.
Figure 4:
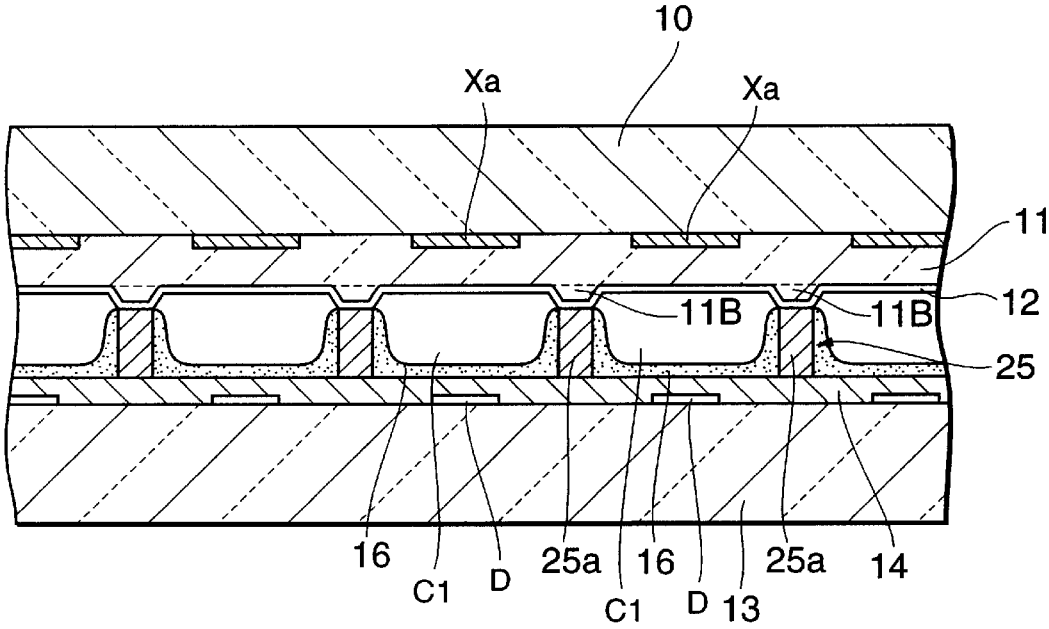
FIG. 4 is a sectional view taken along the W3—W3 line of FIG. 1.

FIG. 1 to FIG. 4 illustrate a first embodiment of a plasma display panel (hereinafter referred to as "PDP") according to the present invention. FIG. 1 is a schematic front view of the PDP in the first embodiment. FIG. 2 is a sectional view taken along the V3—V3 line of FIG. 1. FIG. 3 is a sectional view taken along the V4—V4 line of FIG. 1. FIG. 4 is a sectional view taken along the W3—W3 line of FIG. 1.

In FIGS. 1 to 4, components the same as or similar to the components in the construction of the conventional PDP illustrated in FIGS. 7 to 11 are indicated by the same or similar reference numerals.

Specifically, on the back surface of a front glass substrate 10 of the PDP in the first embodiment, row electrodes X, Y each comprising transparent electrodes Xa, Ya and a bus electrode Xb, Yb are arranged in alternate positions in the column direction to make a pair with each other. Each of the transparent electrodes Xa, Ya is formed of a transparent conductive film made of ITO or the like into a T-letter shape, and each of the bus electrodes Xb, Yb is formed of a metal film having a double-layer structure made up of a black conductive layer Xb', Yb' and a main conductive layer Xb", Yb", and extends in the row direction of the front glass substrate 10 and is connected to a base member, having a smaller width, of each of the transparent electrodes Xa, Ya. A plurality of the row electrode pairs (X, Y) are arranged parallel to each other in the column direction of the front glass substrate 10 (the vertical direction in FIG. 1).

Each of the transparent electrodes Xa and Ya which are arranged along the corresponding bus electrodes Xb and Yb of each row electrode pair (X, Y) extends toward the other row electrode of the row electrode pair (X, Y), so that the transparent electrodes Xa and Ya face each other with a discharge gap g in between.

A dielectric layer 11 is also formed on the back surface of the front glass substrate 10 to cover the row electrode pairs (x, Y).

On the back surface of the dielectric layer 11, a first additional dielectric layer 11A protrudes from the back surface of the dielectric layer 11 in a position opposite to the adjacent bus electrodes Xb and Yb of the respective row electrode pairs (X, Y) adjacent to each other and also opposite to a region between the adjacent bus electrodes Xb and Yb, so as to extend in parallel to the bus electrodes Xb, Yb.

On the back surface of the dielectric layer 11, a second additional dielectric layer 11B also extends in the column direction in an area opposite to a mid-position between adjacent transparent electrodes Xa and between adjacent transparent electrodes Ya which are arranged along the corresponding bus electrodes Xb and Yb of the row electrodes X and Y. The second additional dielectric layer 11B includes a groove 11Ba (see FIG. 3) which extends in the row direction and has both ends opening on both side faces of the second additional dielectric layer 11B.

A protective layer 12 made of MgO is formed on the back surfaces of the dielectric layer 11, first additional dielectric layers 11A and second additional dielectric layer 11B.

On the other hand, the back glass substrate 13 has a surface on the display surface side, on which each of column electrodes D extends in the column direction in a position opposite to the paired transparent electrodes Xa and Ya of each row electrode pair (X, Y), and further a white dielectric layer 14 covers the column electrodes D.

On the dielectric layer 14, partition walls 25 are formed in the following configuration.

Each of the partition walls 25 comprises vertical walls 25*a* each extending in the column direction in a position between adjacent column electrodes D placed parallel to each other, and transverse walls 25*b* each coupled to each end of each vertical wall 25*a* for connection between vertical walls 25*a*. Each of the transverse walls 25*b* is constituted by diagonal walls 25*b*' slanting in a upper right direction and diagonal walls 25*b*" slanting in a upper left direction which are alternated in position to form a shape of continuously coupling V-letters or inverted-V-letters. A coupling part j1 between the diagonal walls 25*b*' and 25*b*" oriented toward the outside of the row electrode pair (X, Y) is situated in a central position midway between adjacent vertical walls 25*a*, and a coupling part j2 between the diagonal walls 25*b*' and 25*b*" oriented toward the inside of the row electrode pair (X, Y) is coupled to the end of each of the vertical walls 25*a*. As a result, an area surrounded by the vertical walls 25*a* and transverse walls 25*b* forms a hexagonal shape.

Each of the coupling parts j1 of the transverse wall 25*b* of the partition wall 25 is positioned outside the connecting part between the transparent electrode Xa (or Ya) and the bus electrode Xb (or Yb) of each row electrode X (or Y). Hence, the transverse wall 25*b* is not disposed in at least a position overlapping the connecting part between the transparent electrode Xa (or Ya) and the bus electrode Xb (or Yb) when viewed from the display surface of the front glass substrate 10.

The partition walls 25 each formed in the approximate ladder shape are arranged parallel to each other in the column direction such that an interstice SL1 is interposed between adjacent partition walls 25 in a position opposite an area between the bus electrodes Xb and Yb of the row electrodes X and Y which are adjacent to each other in the column direction and positioned back to back.

Each of the partition walls 25 partitions the discharge space, interposed between the front glass substrate 10 and the back glass substrate 13, into areas each opposite to the transparent electrodes Xa and Ya paired in each row electrode pair (X, Y), to define discharge cells C1 each formed in a hexagonal shape.

At this point, as illustrated in FIG. 2, the transverse wall 25*b* is in contact with the first additional dielectric layer 11A to completely block a discharge cell C1 from another discharge cell C1 adjacent thereto in the column direction. As illustrated in FIGS. 3 and 4, the vertical wall 25*a* is in contact with the second additional dielectric layer 11B to block a discharge cell C1 from another discharge cell C1 adjacent thereto in the row direction, but the groove 11Ba formed in the second additional dielectric layer 11B makes a communication between the discharge cells C1 adjacent to each other in the row direction.

In each discharge cell C1, a phosphor layer 16 is provided on a face of the dielectric layer 14 and the four side faces of the vertical walls 25*a* and transverse walls 25*b* of the partition wall 25 which face toward the discharge cell C1 so as to cover all the five faces. The phosphor layers 16 are arranged in order a red color, a green color and a blue color in the row direction for each discharge cell C.

The discharge space between the front glass substrate 10 and the back glass substrate 13 is filled with a discharge gas.

As in the case of the example of the prior art, in the PDP according to the present invention, an addressing discharge is selectively caused between one of the row electrodes X, Y and the column electrode D in each discharge cells C, whereby lighted cells and non-lighted cells are distributed over the panel in accordance with an image to be displayed.

Then, a discharge sustaining pulse is simultaneously applied alternately to the row electrodes X and Y of each pair to cause a sustaining discharge between the mutually opposite transparent electrodes Xa and Ya of the paired row electrodes X and Y in each lighted cell. Ultraviolet rays generated through the sustaining discharge excite the red (R), green (G) or blue (B) phosphor layer 16 to allow the phosphor layer 16 to emit light for an image corresponding to a video signal.

At this point, with the above PDP, the coupling part j1 of the transverse wall 25*b* forming part of the partition wall 25 is situated in a central position midway between adjacent vertical walls 25*a*, and outside a connecting part between the transparent electrode Xa (or Ya) and the bus electrode Xb (or Yb) of each row electrode X (or Y), so that at least each connecting part between the transparent electrode Xa (or Ya) and the bus electrode Xb (or Yb) does not overlap the transverse wall 25*b* when viewed from the display surface of the front glass substrate 10. With this design, in causing the sustaining discharge between the mutually opposite transparent electrodes Xa and Ya, the sustaining discharge is not impaired by the transverse wall 25*b* of the partition wall 25. As a result, even if high definition of the PDP is increasingly developed, it is possible to prevent the forming of images from being adversely affected by deterioration of the discharge properties of the sustaining discharge.

Further, with the aforementioned PDP, a distance between the coupling parts j2 of the paired transverse walls 25*b* connected to both ends of each of the vertical walls 25*a* is shorter than a distance between the coupling parts j1 of the transverse walls 25*b* concerned. This design prevents a false discharge from being caused through the bus electrodes Xb, Yb around the boundary between discharge cells C1 adjacent to each other in the row direction.

Figure 5:
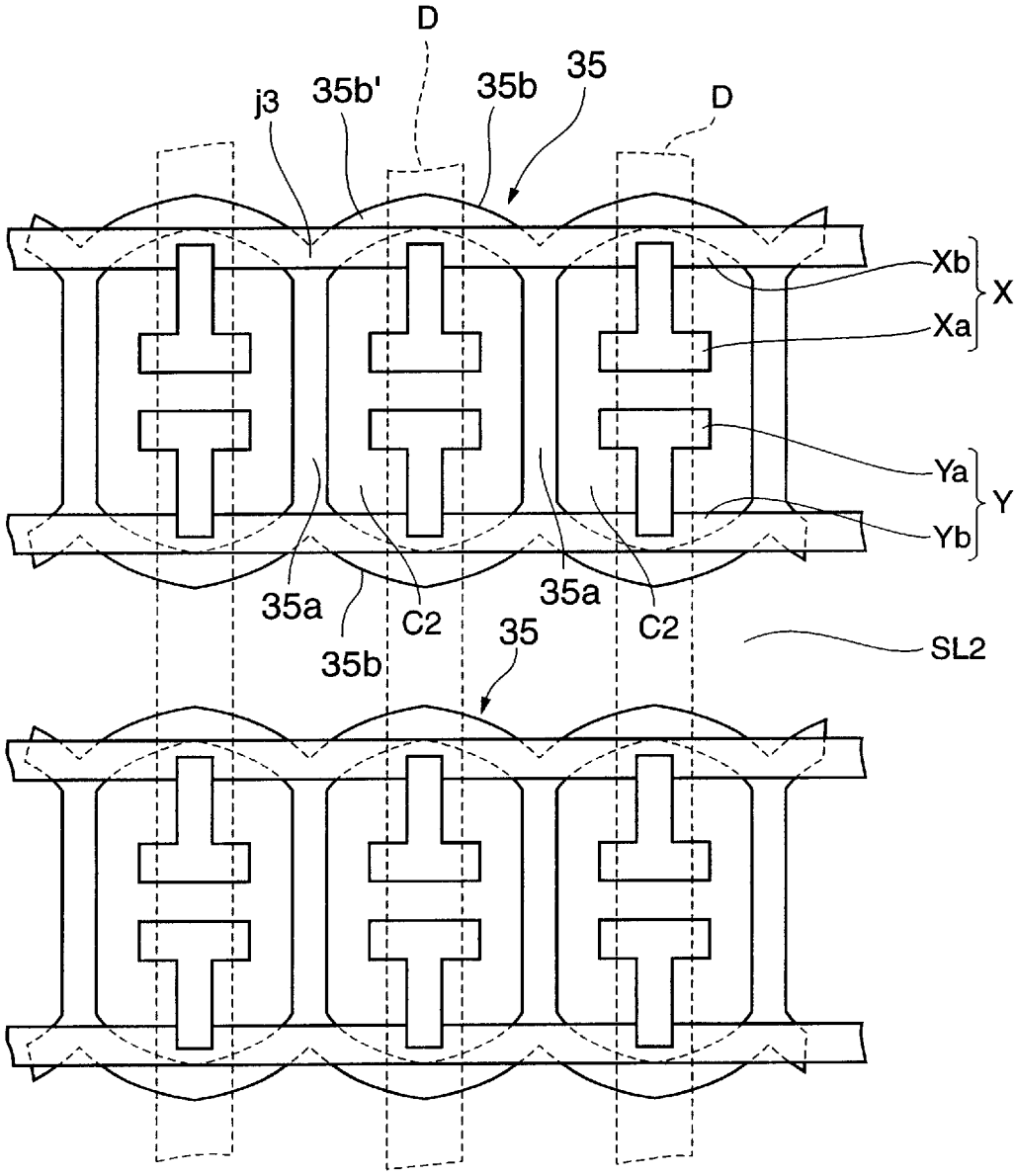
FIG. 5 is a schematic front view illustrating a second embodiment according to the present invention.

FIG. 5 is a schematic front view illustrating a second embodiment of the PDP according to the present invention.

The PDP in the first embodiment has the partition wall 25 including the transverse wall 25*b* formed in the shape of continuously coupling V-letters or inverted-V-letters. In the second embodiment, the PDP has a transverse wall 35*b* which is formed in a shape of continuously coupling arc elements 35*b*' each curving in a direction of the outside of the row electrode pair (X, Y). Each of coupling parts j3 between the arc elements 35*b*' is coupled to an end of each vertical wall 35*a* to form an athletic-track-like shape in an area surrounded by the transverse walls 35*a* and the transverse walls 35*b*.

Each of the arc elements 35*b*' of the transverse wall 35*b* of the partition wall 35 has a central part oriented toward the outside of the row electrode pair (X, Y). The central part of the element 35*b*' is positioned outside the connecting part between the transparent electrode Xa (or Ya) and the bus electrode Xb (or Yb) of each row electrode X (or Y). Hence, the transverse wall 35*b* is not disposed in a position overlapping at least each connecting part between the transparent electrode Xa (or Ya) and the bus electrode Xb (or Yb) when viewed from the display surface of the front glass substrate 10.

The partition walls 35 each shaped in the approximate ladder pattern are arranged parallel to each other in the column direction such that an interstice SL2 is interposed between adjacent partition walls 35 in a position opposite an area between the bus electrodes Xb and Yb of the row electrodes X and Y which are adjacent to each other in the column direction and positioned back to back.

Each of the partition walls 35 partitions the discharge space, interposed between the front glass substrate 10 and the back glass substrate 13, into areas each opposite to the transparent electrodes Xa and Ya paired in each row electrode pair (X, Y), to define discharge cells C2 each formed in an approximately elliptical shape.

As in the case of the PDP in the first embodiment, with the PDP in the second embodiment, the central part of the arc element 35*b*', located midway between adjacent vertical walls 35*a*, of the transverse wall 35*b* forming part of the partition wall 35, is disposed outside each connecting part between the transparent electrode Xa (or Ya) and the bus electrode Xb (or Yb) of each row electrode X (or Y), so that at least the connecting part between the transparent electrode Xa (or Ya) and the bus electrode Xb (or Yb) and the transverse wall 35*b* do not overlap each other.

With this design, in causing the sustaining discharge between the mutually opposite transparent electrodes Xa and Ya, the sustaining discharge is not impaired by the transverse wall 35*b* of the partition wall 35. As a result, even if high definition of the PDP is increasingly developed, it is possible to prevent the forming of images from being adversely affected by deterioration of the discharge properties of the sustaining discharge.

Further, with the aforementioned PDP, a distance between the coupling parts j3 of the paired transverse walls 35*b* connected to both ends of each of the vertical walls 35*a* is shorter than a distance between the central parts of the arc elements 35*b*' of the transverse walls 35*b* concerned. This design prevents a false discharge from being caused through the bus electrodes Xb, Yb around the boundary between discharge cells C2 adjacent to each other in the row direction.

Figure 6:
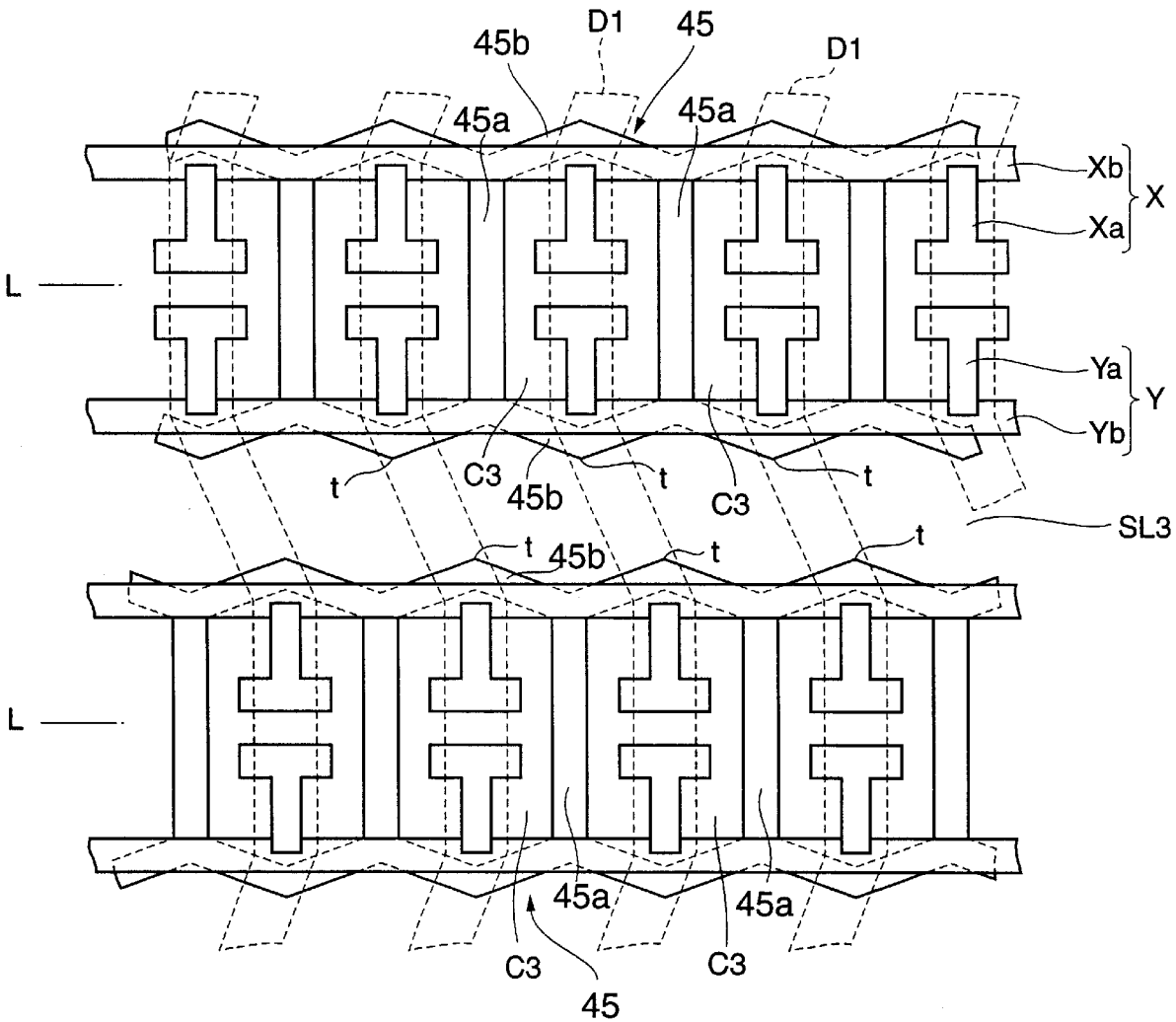
FIG. 6 is a schematic front view illustrating a third embodiment according to the present invention.
Figure 7:
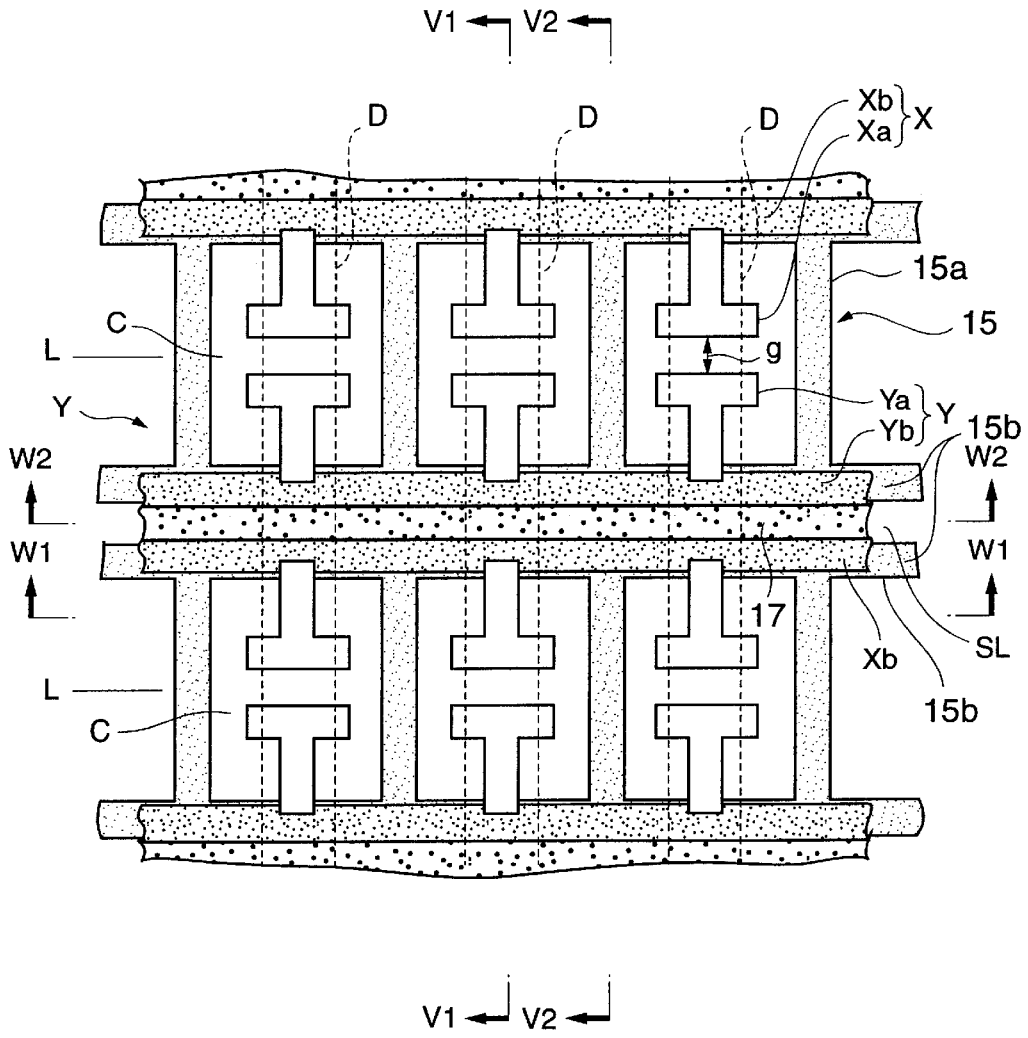
FIG.7 PRIOR ART
FIG. 7 is a schematic front view illustrating construction of a conventional PDP.
Figure 8:
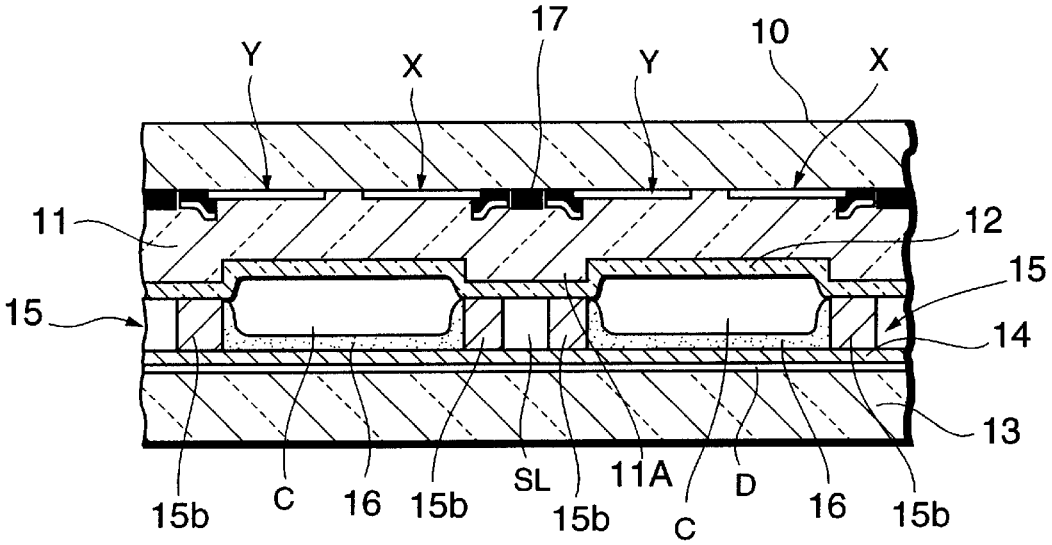
FIG.8 PRIOR ART
FIG. 8 is a sectional view taken along the V1—V1 line of FIG. 7.
Figure 9:
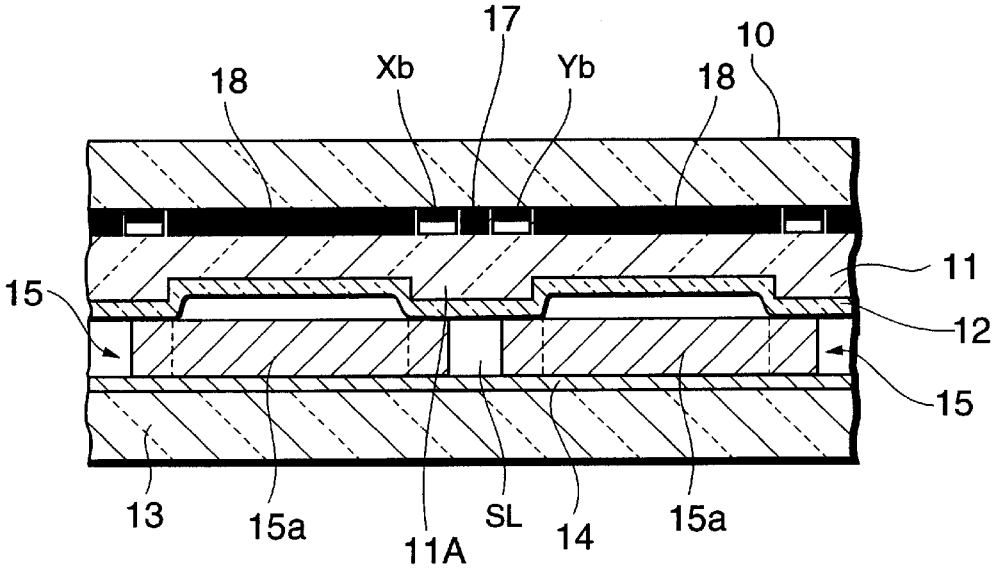
FIG.9 PRIOR ART
FIG. 9 is a sectional view taken along the V2—V2 line of FIG. 7.
Figure 10:
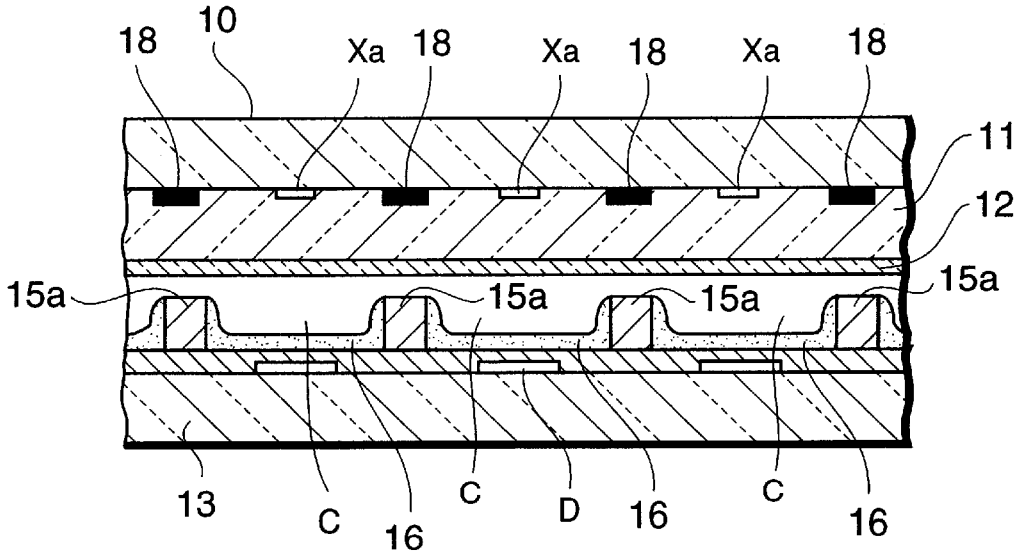
FIG.10 PRIOR ART
FIG. 10 is a sectional view taken along the W1—W1 line of FIG. 7.
Figure 11:
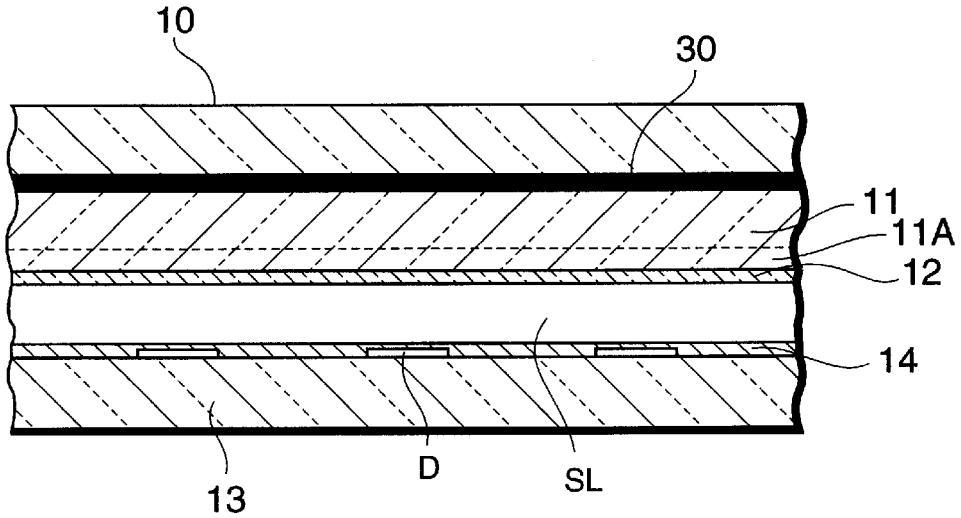
FIG.11 PRIOR ART
FIG. 11 is a sectional view taken along the W2—W2 line of FIG. 7.

FIG. 6 is a schematic front view illustrating a third embodiment of the PDP according to the present invention.

The PDP in the third embodiment is equal to the PDP in the first embodiment in that: a transverse wall 45*b* of a partition wall 45 is formed in a shape of continuously coupling V letters or inverted-V letters; an area surrounded by the transverse walls 45*b* and vertical walls 45*a* is provided in a hexagonal shape; and the approximately ladder-shaped partition walls 45 are arranged parallel to each other in the column direction such that an interstice SL3 is interposed between adjacent partition walls 45 in a position opposite an area between the bus electrodes Xb and Yb of the row electrodes X and Y which are adjacent to each other in the column direction and positioned back to back. However, the partition walls 45 in adjacent display lines L in the third embodiment are shifted in position in the row direction by a half pitch. Accordingly, discharge cells C3 defined by the partition wall 45 are also arranged in positions shifted in the row direction by a half pitch between the adjacent display lines L.

In accordance with the offset arrangement of the discharge cells C3 shifted in position in the row direction by a half pitch between adjacent display lines L, each of column electrodes D1 is also formed in an approximately corrugated shape offset in the row direction by a half pitch between adjacent display lines L.

With the PDP in the third embodiment, a protrusion t is provided in a central point of each part of the transverse wall 45*b* bridged between adjacent vertical walls 45*a* of the partition wall 45 and projects in a direction of the outside of the row electrode pair (X, Y). The protrusions t are staggered in adjacent display lines L.

This design makes it possible to place the back-to-back transverse walls 45*b* of the partition walls 45 adjacent to each other, in a position closer to each other in the column direction as compared with the case of the partition walls 25, 35 in the first and second embodiments. Hence, each of the discharge cells C3 can be increased in length in the column direction, resulting in provision of the further satisfactory discharge properties when causing the sustaining discharge, and in implementation of increasingly higher definition for PDPs.

The foregoing embodiments has been made by use the examples: that the transverse wall of the partition wall is formed in a shape of continuously coupling V-letters or inverted-V-letters so that the transverse walls and vertical walls defines the discharge cell in a hexagonal shape; and that the transverse wall of the partition wall is formed in a continuous arc shape so that the transverse walls and vertical walls define the discharge cell in an approximately oval shape. However, a shape of the transverse wall of the partition wall in the present invention is not limited to the shape described in each of the above examples, and it is possible to employ various shapes in which a central part of a transverse wall situated midway between adjacent vertical walls of a partition wall protrudes in a direction of the outside of the row electrode pair (X, Y) such that at least the connecting part between the transparent electrode Xa (Ya) and the bus electrode Xb (Yb) does not overlap the central portion of the transverse wall when viewed from the display surface of the front glass substrate 10.

The foregoing has described the example that the bus electrodes Xb, Yb of the row electrodes X, Y and the first additional dielectric layer 11A extending in the row direction are formed in a straight line, but they may be formed in an approximately corrugated shape in accordance with the shape of the transverse wall of the partition wall.

The terms and description used herein are set forth by way of illustration only and are not meant as limitations. Those skilled in the art will recognize that numerous variations are possible within the spirit and scope of the invention as defined in the following claims.

What is claimed is:

1. A plasma display panel including a front substrate, a plurality of row electrode pairs arranged in a column direction on a back surface of the front substrate and each extending in a row direction and forming a display line, a back substrate placed opposite the front substrate with a discharge space interposed, and a plurality of column electrodes arranged in the row direction on a surface of the back substrate facing toward the front substrate and each extending in the column direction to intersect the row electrode pairs and form unit light-emitting areas in the discharge space at the respective intersections, said plasma display panel comprising, partition walls provided between the front substrate and the back substrate for defining each of the unit light-emitting areas, each of the partition walls comprising, vertical walls each positioned between adjacent unit light-emitting areas of the unit light-emitting areas in the row direction and extending in the column direction to form a partition between the adjacent unit light-emitting areas, and transverse walls bridging the vertical walls to define a top and bottom edge of the unit light-emitting areas, each transverse wall having an edge part, defining each of the unit light-emitting areas, having a central part located midway between adjacent vertical walls of the vertical walls protruding beyond a part coupled to the vertical wall toward the outside of the unit light-emitting area in the column direction.

2. A plasma display panel according to claim 1, wherein said transverse wall is formed in a band shape protruding toward the outside of each of the unit light-emitting areas in the column direction and toward a central point midway between the adjacent vertical walls from a point coupled to one of the adjacent vertical walls.

3. A plasma display panel according to claim 2, wherein said transverse wall extends linearly toward the central point midway between the adjacent vertical walls from the point coupled to the one of the adjacent vertical walls.

4. A plasma display panel according to claim 2, wherein said transverse wall extends in a curved line toward the central point midway between the adjacent vertical walls from the point coupled to the one of the adjacent vertical walls.

5. A plasma display panel according to claim 4, wherein said transverse wall is formed in an arc shape curving in a direction of the outside of the unit light-emitting area in the column direction, between the adjacent vertical walls.

6. A plasma display panel according to claim 1, wherein each of said vertical walls of said partition wall in one row, arranged at required intervals in the row direction, is placed in a position shifted by a required length from a corresponding vertical wall of said vertical walls in another row adjacent to the one row in the column direction.

7. A plasma display panel according to claim 6, wherein said adjacent vertical walls in two rows adjacent to each other in the column direction are shifted in the row direction by a length corresponding to half a length between the vertical walls adjacent to each other in the row direction in each row.

* * * * *

UNITED STATES PATENT AND TRADEMARK OFFICE

CERTIFICATE OF CORRECTION

PATENT NO. : 6,661,170 B2
DATED : December 9, 2003
INVENTOR(S) : Klmlo Amemiya

It is certified that error appears in the above-identified patent and that said Letters Patent is hereby corrected as shown below:

Title page,
Item [73], Assignee, please change the second Assignee's name and address as follows:
-- Pioneer Display Products Corporation, Shizuoka-ken (JP) --.

Signed and Sealed this

Tenth Day of August, 2004

JON W. DUDAS
*Acting Director of the United States Patent and Trademark Office*